US007581402B2

(12) United States Patent
Parker

(10) Patent No.: US 7,581,402 B2
(45) Date of Patent: Sep. 1, 2009

(54) TURBINE ENGINE COMBUSTOR WITH BOLTED SWIRLERS

(75) Inventor: David Marchant Parker, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 585 days.

(21) Appl. No.: 11/053,353

(22) Filed: Feb. 8, 2005

(65) Prior Publication Data

US 2006/0174631 A1 Aug. 10, 2006

(51) Int. Cl.
*F02C 7/20* (2006.01)
*F02C 1/00* (2006.01)

(52) U.S. Cl. ..... 60/798; 60/796; 60/748

(58) Field of Classification Search ..... 60/748, 60/740, 777, 776, 804, 796, 798, 799, 800
See application file for complete search history.

(56) References Cited

U.S. PATENT DOCUMENTS 2,428,999 A * 10/1947 Smith et al. ..... 415/201
4,044,553 A * 8/1977 Vaught ..... 60/39.23
5,239,832 A 8/1993 Koshoffer et al.
6,148,600 A 11/2000 Farmer et al.
6,212,870 B1 4/2001 Thompson et al.
6,314,739 B1 11/2001 Howell et al.
6,415,610 B1 * 7/2002 Parker ..... 60/798
6,427,435 B1 8/2002 Patterson et al.
6,453,671 B1 9/2002 Leen et al.
6,453,675 B1 * 9/2002 Royle ..... 60/800
6,457,316 B1 10/2002 Czachor et al.
6,502,399 B2 1/2003 Mandai et al.
6,519,836 B2 * 2/2003 Watanabe et al. ..... 29/714
6,581,386 B2 6/2003 Young et al.
6,655,027 B2 12/2003 Kastrup et al.
6,672,073 B2 1/2004 Wiebe
6,705,087 B1 3/2004 Ohri et al.
6,708,498 B2 3/2004 Stickles et al.
6,725,667 B2 4/2004 Farmer et al.
7,062,920 B2 * 6/2006 McMasters et al. ..... 60/800
7,080,515 B2 * 7/2006 Wasif et al. ..... 60/737
7,197,877 B2 * 4/2007 Moraes ..... 60/740
2003/0226361 A1 12/2003 Stickles et al.
2004/0065090 A1 4/2004 Al Roub et al.

* cited by examiner

*Primary Examiner*—Michael Cuff
*Assistant Examiner*—Gerald L Sung

(57) ABSTRACT

Aspects of the invention relate to a system for attaching a fuel swirler assembly in a turbine engine combustor. According to embodiments of the invention, at least an axial upstream end of the fuel swirler assembly can be attached to a combustor support frame using one or more fasteners, such as bolts. The fuel swirler assembly can include a radial bracket provided on the swirler body to facilitate attachment. The axial downstream end of the fuel swirler assembly can be positioned within an opening defined in a swirler base plate or within an opening in a swirler support plate. Aspects of the invention can reduce the time and cost associated with installation and replacement of fuel swirlers in a combustor while avoiding concerns associated with known welded pin attachment systems.

20 Claims, 6 Drawing Sheets

TURBINE ENGINE COMBUSTOR WITH BOLTED SWIRLERS

FIELD OF THE INVENTION

The invention relates in general to turbine engines and, more specifically, to fuel swirlers in the combustor section of a turbine engine.

BACKGROUND OF THE INVENTION

The use of fuel swirlers in the combustor section of a turbine engine is known. FIG. 1 shows an exemplary prior art fuel swirler 10 for a main fuel nozzle 20. The fuel swirler 10 includes a substantially cylindrical tapered body 11. The fuel swirler 10 has a flared inlet end 12 and a tapered outlet end 14. A plurality of swirler vanes 16 are disposed circumferentially around the inner peripheral surface 18 of fuel swirler 10 proximate the inlet end 12. The swirler vanes 16 are attached to a hub 26. The hub 26 surrounds the main fuel nozzle 20.

The fuel swirler 10 surrounds a portion of a main fuel nozzle 20 proximate main fuel injection ports 22. The fuel swirler 10 is positioned such that the swirler vanes 16 are upstream of the main fuel injection ports 22. The inlet end 12 is adapted to receive compressed air 23 from the compressor section of the engine (not shown) and to channel it into the swirler vanes 16. The swirler vanes 16 disrupt the flow of the compressed air 23 through the swirler 10 to promote mixing of the air 23 with fuel introduced through the ports 22. The outlet end 14 of the swirler 10 is adapted to fit into a swirler extension sleeve 24.

In prior art systems, the fuel swirler 10 is attached to a combustor support frame 30 by two support pins 28. Each support pin 28 is welded at one end to the combustor support frame 30 and at the other end to the swirler body 11. However, experience has revealed problems with such an attachment scheme. The support pins 28 are subjected to vibrational forces generated during combustion; consequently, the support pins 28 and/or the welds are susceptible to fatigue-induced cracking. The formation of cracks in the support pins 28 or welds has prompted unscheduled engine shut down and has lead to costly and protracted repair and replacement.

Further, attachment of the support pins 28 to the swirler 10 and combustor support frame 30 by welding can complicate the combustor assembly process. During post-welding cool down, the swirlers 10 have been known to move out of their design position. Combustor performance can be adversely affected if the swirlers 10 and the main fuel nozzle 20 are not properly aligned. Thus, the assembly process may require additional steps to realign these components. One realignment method includes physically bending the swirler 10 into the design position. However, such cold bending can cause residual stresses to develop in the pins 28, and such stresses can further reduce the fatigue life of the swirler 10 and/or the pins 28. Thus, there is a need for a swirler attachment system that minimizes the foregoing concerns.

SUMMARY OF THE INVENTION

Aspects of the invention are directed to a fuel swirler assembly for a turbine engine combustor. The fuel swirler assembly includes an elongated swirler body that has an inlet end and an outlet end. The swirler body defines a longitudinal axis. The swirler body has an outer peripheral surface and an inner peripheral surface. A plurality of swirler vanes extend radially inward from the inner peripheral surface of the swirler body. The vanes are arrayed about the inner peripheral surface of the swirler proximate the inlet end.

A bracket is secured to the outer peripheral surface of the swirler body. The bracket projects substantially radially outward from the swirler body to a radially distal end. The bracket includes a hole adapted for removably receiving a fastener. In one embodiment, the hole can be threaded. Thus, the hole can receive and can threadably engage a threaded fastener.

The hole extends radially inward from the radially distal end of the bracket. The bracket is located on the swirler body in a region defined between the inlet end and an axially central region of the swirler body. In one embodiment, the bracket and the swirler body can be unitary. Alternatively, the bracket and the swirler body can be separate. In such case, the bracket can be secured to the swirler body by welding. The bracket can further have a radially proximal end. The radially proximal end of the bracket can substantially matingly engage the outer peripheral surface of the swirler body.

In one embodiment, there can be a second bracket. The second bracket can be secured to the outer peripheral surface of the swirler body. In such case, the second bracket can be located in a region defined between the inlet end and an axially central region of the swirler body. Alternatively, the second bracket can be located on a swirler extension sleeve that is secured to the swirler body. The outlet end of the swirler body can be received within the swirler extension sleeve.

Aspects of the invention further relate to a swirler attachment system. The system includes a combustor support frame, a fuel swirler assembly including a bracket, and a fastener. The combustor support frame has an inner peripheral surface and an outer peripheral surface. A radial hole extends through the combustor support frame from the inner peripheral surface to the outer peripheral surface.

The fuel swirler assembly includes an elongated swirler body that has an inlet end and an outlet end. In addition, the swirler body has an outer peripheral surface and an inner peripheral surface. Further, the swirler body defines a longitudinal axis. The bracket is secured to the outer peripheral surface of the swirler body. The bracket projects substantially radially outward from the swirler body to a radially distal end. The bracket includes a hole adapted for removably receiving a fastener. The hole extends radially inward from the radially distal end of the bracket. The bracket is located on the swirler body in a region defined between the inlet end and an axially central region of the swirler body.

The fastener extends through the radial hole in the combustor support frame. The fastener is attached within with the hole in the bracket so as to secure the fuel swirler assembly to the combustor support frame. In one embodiment, the fastener can be a threaded bolt. Further, the radial hole in the bracket can be threaded. Thus, the hole can threadably engage the bolt. In one embodiment, the fastener and/or the hole in the bracket can include a special thread form to impede unwanted travel of the fastener.

The radial hole can be adapted to provide a substantially dowel fit with the bolt. In such case, movement of the bolt within the hole can be substantially minimized. Further, a lock washer can be provided and operatively positioned between the fastener and the outer peripheral surface of the combustor support frame. The lock washer can impede unwanted travel of the fastener.

The radially distal end of the bracket substantially engages the inner peripheral surface of the combustor support frame. The inner peripheral surface of the combustor support frame can have a seating surface. The seating surface can be adapted for substantially mating engagement with the radially distal end of the bracket. The seating surface can be defined by a recess in the inner peripheral surface of the combustor support frame. Alternatively, the seating surface can be defined by a protrusion extending radially inward from the inner peripheral surface of the combustor support frame.

The system can include a swirler base plate that can be secured to the combustor support frame. The swirler base plate can include an opening. The axial downstream end of the fuel swirler assembly can be positioned substantially adjacent to the opening. Thus, the fuel swirler assembly and the opening can be in fluid communication. Alternatively, the axial downstream end of the fuel swirler assembly can be received within the opening.

In one embodiment, the system can further include a swirler support plate and a swirler base plate. The swirler support plate can include an opening for receiving the axial downstream end of the fuel swirler assembly. In one embodiment, the swirler support plate can be made of four panels. The swirler base plate can include an opening. The opening in the swirler support plate can be disposed axially upstream of and in substantial alignment with the opening in the swirler base plate. A portion of the fuel swirler assembly can be received within the opening in the swirler support plate. The swirler base plate can be attached to the combustor support frame, and the swirler support plate can be attached to the swirler base plate. A portion of the fuel swirler assembly can extend through the opening in the swirler support plate such that the axial downstream end of the fuel swirler assembly can be positioned substantially proximate to the opening in the swirler base plate. A peripheral gap can be formed between the axial downstream end of the fuel swirler assembly and the swirler base plate. As a result, air can pass through the gap so as to minimize flashback potential.

DETAILED DESCRIPTION OF EMBODIMENTS OF THE INVENTION

Embodiments of the present invention are directed to swirler attachment systems. Embodiments of the invention will be explained in the context of one possible system, but the detailed description is intended only as exemplary. Embodiments of the invention are shown in FIGS. 2-7, but the present invention is not limited to the illustrated structure or application.

Figure 1:
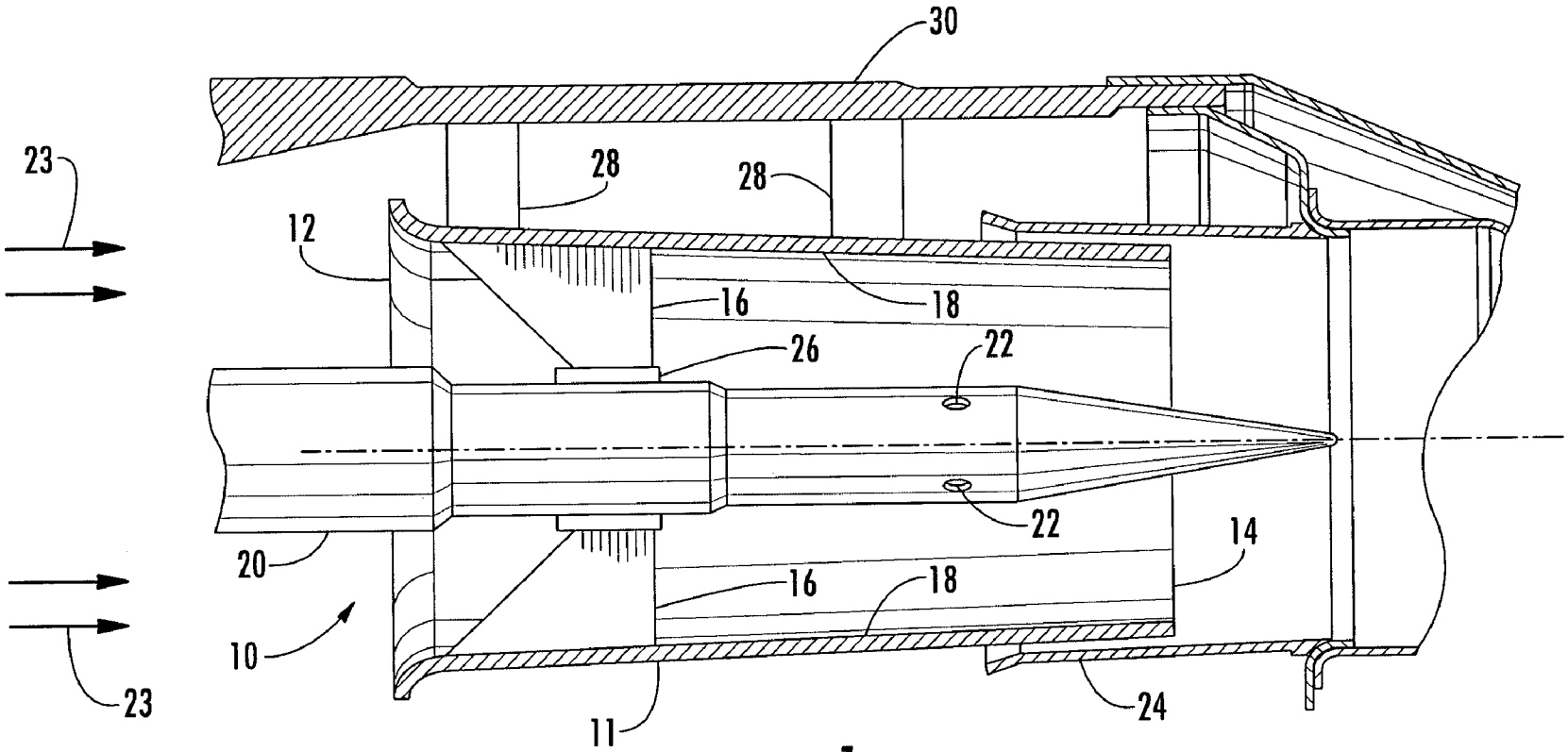
FIG. 1 (PRIOR ART)
FIG. 1 is a cross-sectional view of a prior main fuel swirler.
Figure 3:
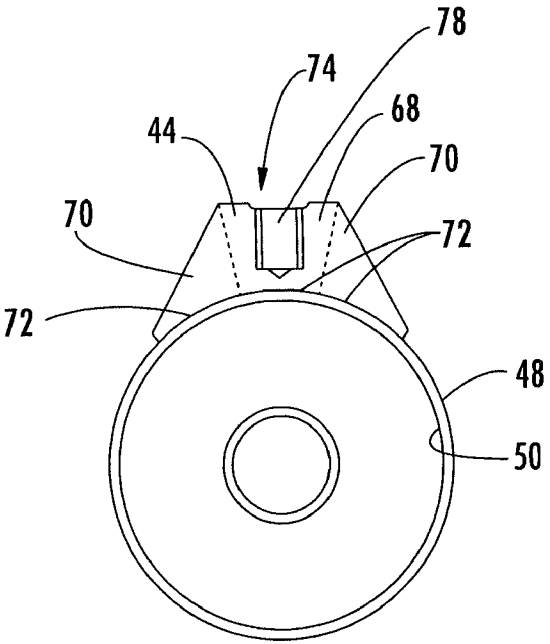
FIG. 3 is a side elevational view of a fuel swirler according to aspects of the invention.
Figure 2:
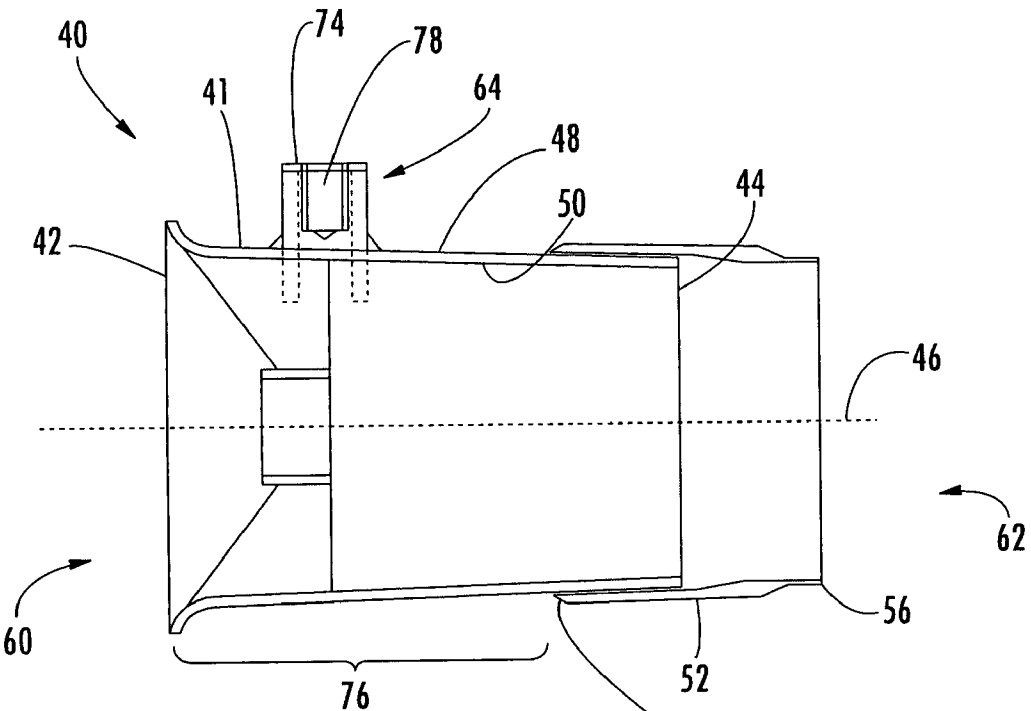
FIG. 2 is a cross-sectional view of a fuel swirler according to aspects of the invention.

A fuel swirler assembly 40 according to embodiments of the invention is shown in FIGS. 2 and 3. The fuel swirler assembly 40 can include a swirler body 41 having an inlet end 42 and an outlet end 44. The fuel swirler assembly 40 can define a longitudinal axis 46. The swirler body 41 can be generally cylindrical in conformation, but the swirler body 41 can have any shape including rectangular or polygonal, as dictated by design considerations and performance requirements. The swirler body 41 can have an outer peripheral surface 48 and an inner peripheral surface 50. As shown, the swirler body 41 can taper from the inlet end 42 to the outlet end 44, but, in some embodiments, the swirler body 41 may not be tapered.

The fuel swirler assembly 40 can include a swirler extension sleeve 52 having a proximal axial end 54 and a distal axial end 56. As used in connection with the swirler extension sleeve 52, the terms "proximal" and "distal" refer to the position of the ends 54, 56 of the swirler extension sleeve 52 relative to the swirler body 41. The swirler extension sleeve 52 can be generally cylindrical in conformation. The outlet end of the swirler body 41 can be positioned so as to extend into the proximal end 54 of the swirler extension sleeve 52. The swirler extension sleeve 52 and the swirler body 41 can be joined together, such as by welding.

It will be appreciated that the inlet end 42 of the swirler body 41 can define the axial upstream end 60 of the fuel swirler assembly 40, and the distal axial end 56 of the swirler extension sleeve 52 can define the axial downstream end 62 of the fuel swirler assembly 40. However, in some instances, the fuel swirler assembly 40 may not include a swirler extension sleeve 52. In such case, the outlet end 44 of the swirler body 41 can define the axial downstream end 62 of the fuel swirler assembly 40. Thus, when the axial downstream end 62 of the fuel swirler assembly 40 is referenced herein, it will be understood that such term can encompass either of the above possibilities.

According to embodiment of the invention, the fuel swirler assembly 40 can include a bracket 64 to facilitate attachment of the fuel swirler assembly 40 to a combustor support frame 66. The bracket 64 can project substantially radially outward (relative to the longitudinal axis 46) from the outer peripheral surface 48 of the swirler body 41. The bracket 64 can be a separate component that is secured to the outer peripheral surface 48 of the swirler body 41. For example, the bracket 64 can be secured to the swirler body 41 by welding. Alternatively, the bracket 64 and the swirler body 41 can be a unitary structure, such as by casting. The bracket 64 can be made of any of a number of materials, but it is preferred if the bracket 64 is made of the same material as the swirler body 41 and/or the combustor support frame 66. In one embodiment, the bracket 64 can be made of stainless steel, such as 304 stainless steel.

The bracket 64 can have any of a number shapes. In one embodiment, the bracket 64 can have a substantially cylindrical body 68 with a pair of attachment fins 70 on each side, as shown in FIGS. 2 and 3. The body 68 may or may not be tapered. Again, the bracket 64 shown in FIGS. 2 and 3 is just one of many possible configurations, and a bracket 64 according to aspects of the invention is not limited to any particular shape.

The bracket 64 can have a radially proximal end 72 and a radially distal end 74 relative to the longitudinal axis 46 of the fuel swirler assembly 40. When the bracket 64 is a separate component, it is preferred if the radially proximal end 72 of the bracket 64 is machined, for example, to be slightly curved, so as to substantially matingly engage a curved outer peripheral surface 48 of the swirler body 41.

Each fuel swirler assembly 40 can have a single bracket 64 for attaching the fuel swirler assembly 40 to the combustor support frame 66. The bracket 64 can be provided at various locations along the swirler body 41. In one embodiment, the bracket 64 can be provided near the inlet end 42 of the swirler body 41. Preferably, the bracket 64 is located within an axial upstream region 76 of the swirler body 41. The axial upstream region 76 can be defined between the inlet end 42 of the swirler body 41 and a substantially axially central portion of the swirler body 41. In some instances, there can be more than one bracket 64 associated with the fuel swirler assembly 40. In one embodiment, there can be two brackets 64 associated with the fuel swirler assembly 40. In such case, the additional bracket (not shown) can be provided on the swirler body 41, preferably also located within the axial upstream region 76. Alternatively, an additional bracket can be attached to the swirler extension sleeve 52 near the proximal axial end 54. While being axially spaced apart, the brackets 64 can be substantially peripherally aligned, or the brackets 64 can be peripherally offset.

The bracket 64 can include a hole 78, which can be threaded and provided by, for example, drilling and tapping. The hole 78 can extend substantially radially inward from the radially distal end 74 of bracket 64 toward the radially proximal end 72 of the bracket 64. The radially distal end 74 of the bracket 64 can be machined so as to substantially matingly engage the combustor support frame 66, and thereby facilitate proper alignment of the fuel swirler assembly 40. In embodiments where the bracket 64 is a separate part that is welded to the swirler body 41, the machining of the radially distal end 74 and the inclusion of the hole 78 can be completed after the welding operation and after the parts have cooled. Thus, any potential warpage caused by the welding can be compensated for without introducing residual stresses to the fuel swirler assembly 40.

Figure 5A:
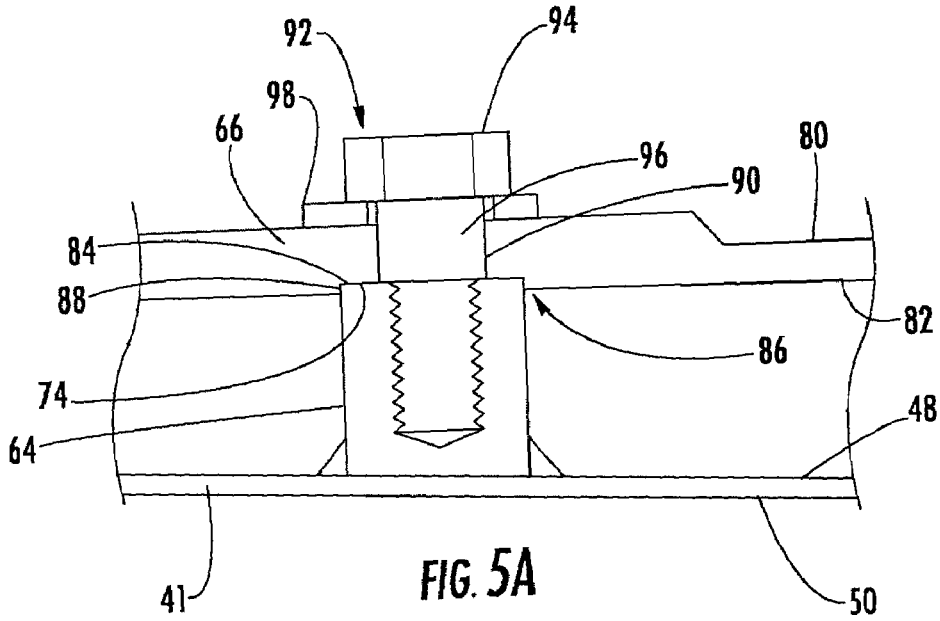
FIG. 5A is a close up view of an interface between the swirler bracket and the combustor support frame according to aspects of the invention.
Figure 5B:
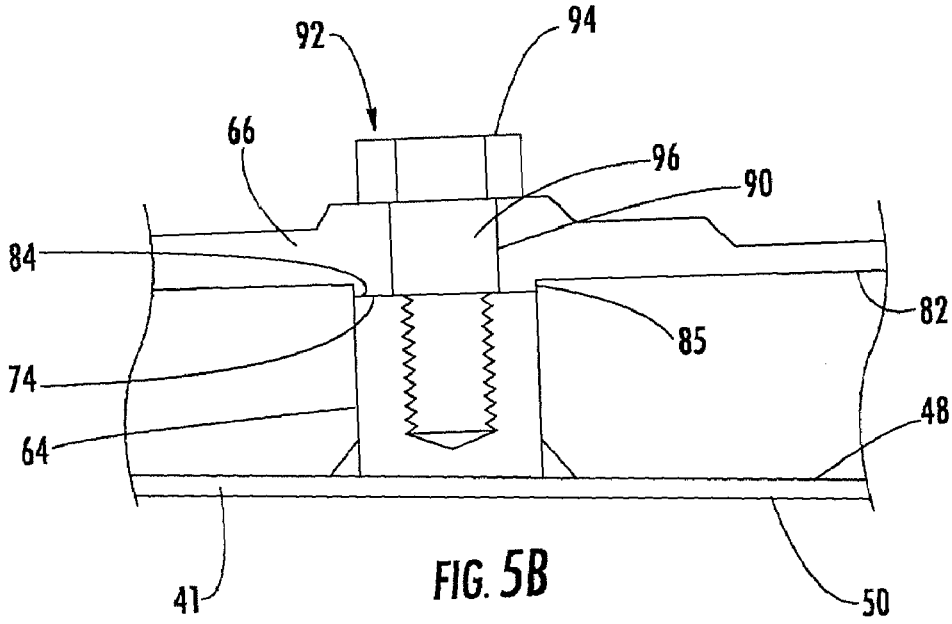
FIG. 5B is a close up view of another interface between the swirler bracket and the combustor support frame according to aspects of the invention.

Again, the fuel swirler assembly 40 can be attached to the combustor support frame 66, which can be any suitable stationary structure in the combustor to which the fuel swirler assemblies 40 can be attached. Referring to FIGS. 5A and 5B, the combustor support frame 66 can have an outer peripheral surface 80 and an inner peripheral surface 82. For each fuel swirler assembly 40, the combustor support frame 66 can provide a seating surface 84 for substantially mating engagement with the radially distal end 74 of the bracket 64.

The seating surface 84 can be a localized precision machined area. The seating surface 84 can include any of a number of surface features, such as protrusions, to engage the radially distal end 74 of the bracket 64. In one embodiment, the seating surface 84 can be defined by a recess 86 for receiving a portion of the bracket 64 including at least the radially distal end 74, as shown in FIG. 5A. The recess 86 can extend radially within the combustor support frame 66, from the inner peripheral surface 82 toward the outward peripheral surface 80. The recess 86 can be included in the combustor support frame 66 by machining. The recess 86 can have any of a number of shapes and, preferably, the recess 86 substantially corresponds to the shape of the radially distal end 74 of the bracket 64. In one embodiment, the recess 86 can be substantially cylindrical. The recess 86 can include the seating surface 84 and at least one sidewall 88. It is preferred if the seating surface 84 is machined for substantially mating engagement with the radially distal end 74 of the bracket 64. Similarly, the sidewall 88 can be machined for additional substantially mating engagement with the bracket 64.

In another embodiment, the seating surface 84 can be defined by a protrusion 85 provided on the inner peripheral surface 82 of the combustor support frame 66, as shown in FIG. 5B. The protrusion 85 can extend radially inward from the inner peripheral surface 82. The protrusion 85 can be formed in the combustor support frame 66 by, for example, machining or casting. The protrusion 85 can have any of a number of shapes and, preferably, the protrusion 85 substantially corresponds to the shape of the radially distal end 74 of the bracket 64. In one embodiment, the protrusion 85 can be substantially cylindrical.

A series of radial holes 90 can be machined in the combustor support frame 66 to provide the required circumferential location of each fuel swirler assembly 40 about the combustor support frame 66. The radial holes 90 can extend from the outer peripheral surface 80 through the inner peripheral surface 82 of the combustor support frame 66, opening to the seating surface 84. Preferably, the radial hole 90 is substantially centered within the seating surface 84. The radial holes 90 can have any of a number of shapes, but preferably they are substantially circular. Naturally, the number of seating surfaces 84 and/or radial holes 90 provided in the combustor support frame 66 will depend on the number of fuel swirler assemblies 40 used and the number of brackets 64 associated with each fuel swirler assembly 40. In one embodiment, there can be eight radial holes 90 and seating surface 84 pairs arranged circumferentially about the combustor support frame 66.

Thus, when the radially distal end 74 of the bracket 64 is positioned against the seating surface 84, the hole 78 in the bracket 64 can be substantially aligned with a respective radial hole 90 in the combustor support frame 66. A fastener can be used to attach the fuel swirler assembly 40 to the combustor support frame 66. In one embodiment, the fastener can be a bolt 92. In such case, the bolt 92 can be inserted from the outer peripheral surface 80 of the combustor support frame 66, such that the head 94 of the bolt 92 operatively engages the outer peripheral surface 80 of the combustor support frame 66. The shaft 96 of the bolt 92 can extend through the radial hole 90 and into threaded engagement with hole 78 in the bracket 64. As the bolt 92 is tightened, the fuel swirler assembly 40 can be pulled into the design position. Preferably, the radial holes 90 in the combustor support frame 66 are sized so as to substantially form a dowel fit with the bolt 92, thereby minimizing movement of the bolt 92 within the hole 78. Dowel fit is intended to mean that a portion of the bolt 92 and the radial holes 90 are tightly toleranced. Movement of the bolt 92 can alter the position of the fuel swirler assembly 40 and affect combustor performance.

In some instances, it may be desirable to provide additional measures to prevent the bolt 92 from moving or otherwise coming loose during engine operation. To that end, a lock washer 98 can be positioned between the head 94 of the bolt 92 and the outer peripheral surface 80 of the combustor support frame 66. Alternatively or in addition, the bolt 92 and/or the hole 78 in the bracket 64 can be provided with a special thread form so as to substantially lock the bolt 94 in place. Yet another possibility for bolt retention is to weld the bolt 92 to the combustor support frame 66. It will be appreciated that the above are merely a few examples of the various manners in which the fastener can be substantially locked in place.

Figure 4:
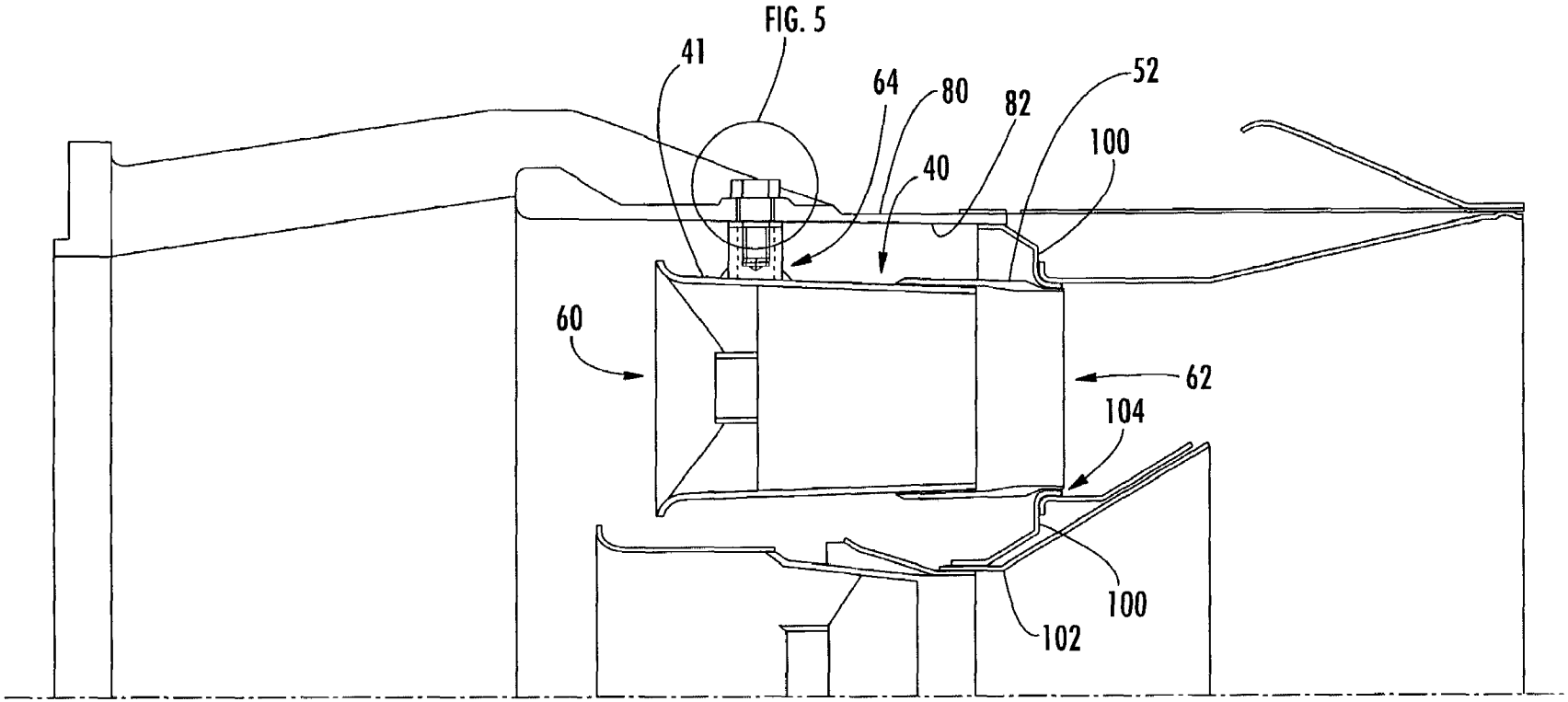
FIG. 4 is a cross-sectional view of a swirler attachment system according to aspects of the invention.

The bracket 64 can be used to support at least the axial upstream end 60 of the fuel swirler assembly 40. Additional support for the axial downstream end 62 of the fuel swirler assembly 40 can be provided as well. Support of the axial downstream end 62 of the fuel swirler assembly 40 can be achieved in numerous ways. For instance, as noted above, an additional bracket 64 can be provided on the fuel swirler assembly 40. In such case, no further support may be needed for the axial downstream end 62 of the fuel swirler assembly 40. In such case, the axial downstream end 62 of the fuel swirler assembly 40 can be positioned substantially adjacent to a swirler base plate 100, as shown in FIG. 4. "Substantially adjacent" is intended to mean direct contact between the axial downstream end 62 of the fuel swirler assembly 40 and the swirler base plate 100 as well as these components being spaced apart.

The swirler base plate 100 can be anchored to the combustor support frame 66 and/or a pilot cone 102 by, for example, welding. A plurality of openings 104 can be provided in the swirler base plate 100 for interfacing with the axial downstream end 62 of the fuel swirler assembly 40. The openings 104 can be a through hole or they can be the product of bends in the swirler base plate 100. While the term "plate" may connote a flat plate, embodiments of the invention are not limited to flat plates as the swirler base plate 100 can include any of a number of curves and bends, among other non-flat features. Typically, the swirler base plate 100 can be shaped from a metal sheet and the openings 104 can be formed in a drawing process.

Especially in cases where only one bracket 64 is provided on the fuel swirler assembly 40, there are various options for supporting the axial downstream end 62 of the fuel swirler assembly 40. In one embodiment, the axial downstream end 62 of the fuel swirler assembly 40 can be positioned within the opening 104 in the swirler base plate 100. The details and benefits of such an arrangement are described in detail in U.S. Pat. No. 6,705,087, which is incorporated herein by reference.

Figure 6:
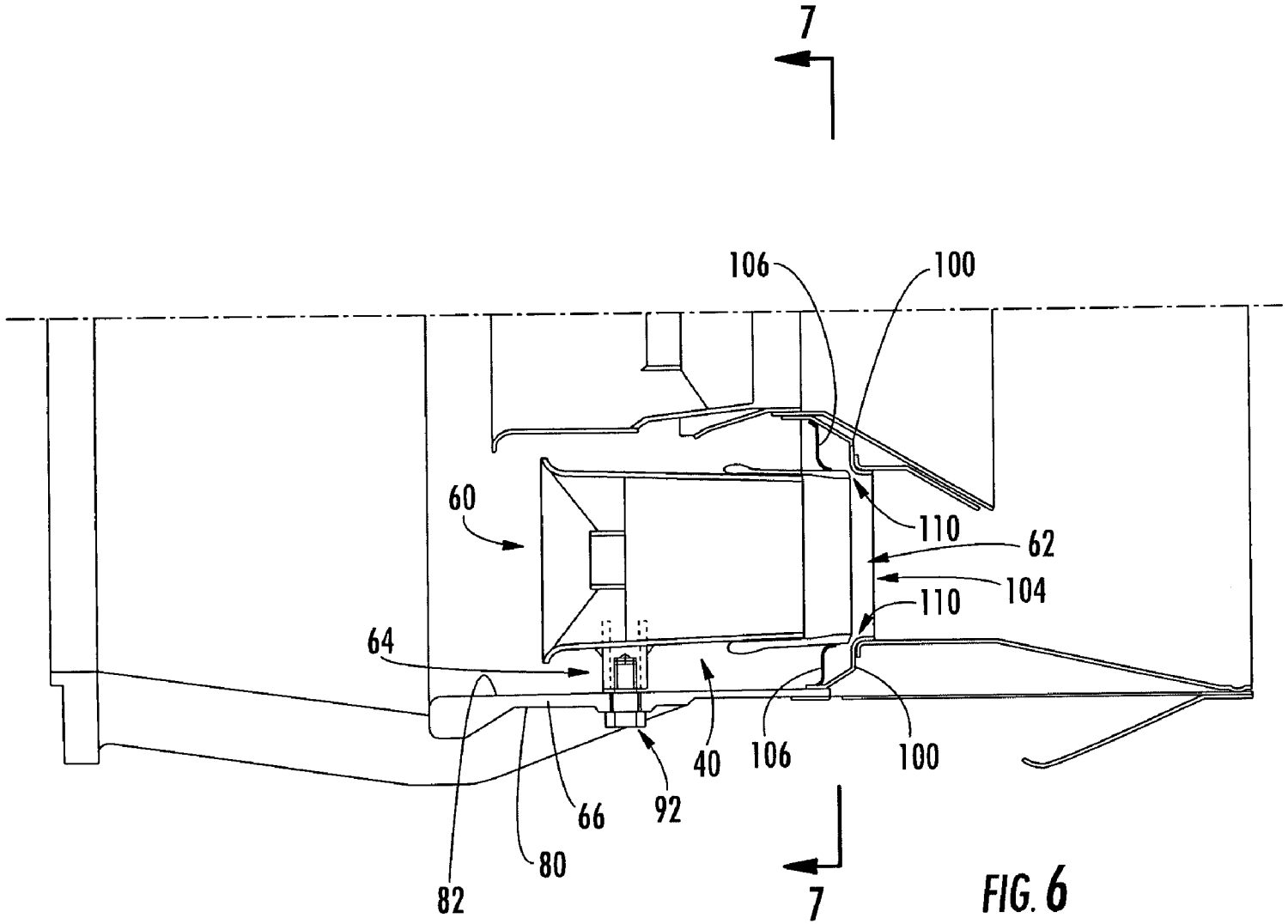
FIG. 6 is a cross-sectional view of the swirler attachment system according to aspects of the invention, showing a swirler support plate provided near the axial downstream end of the swirler.
Figure 7:
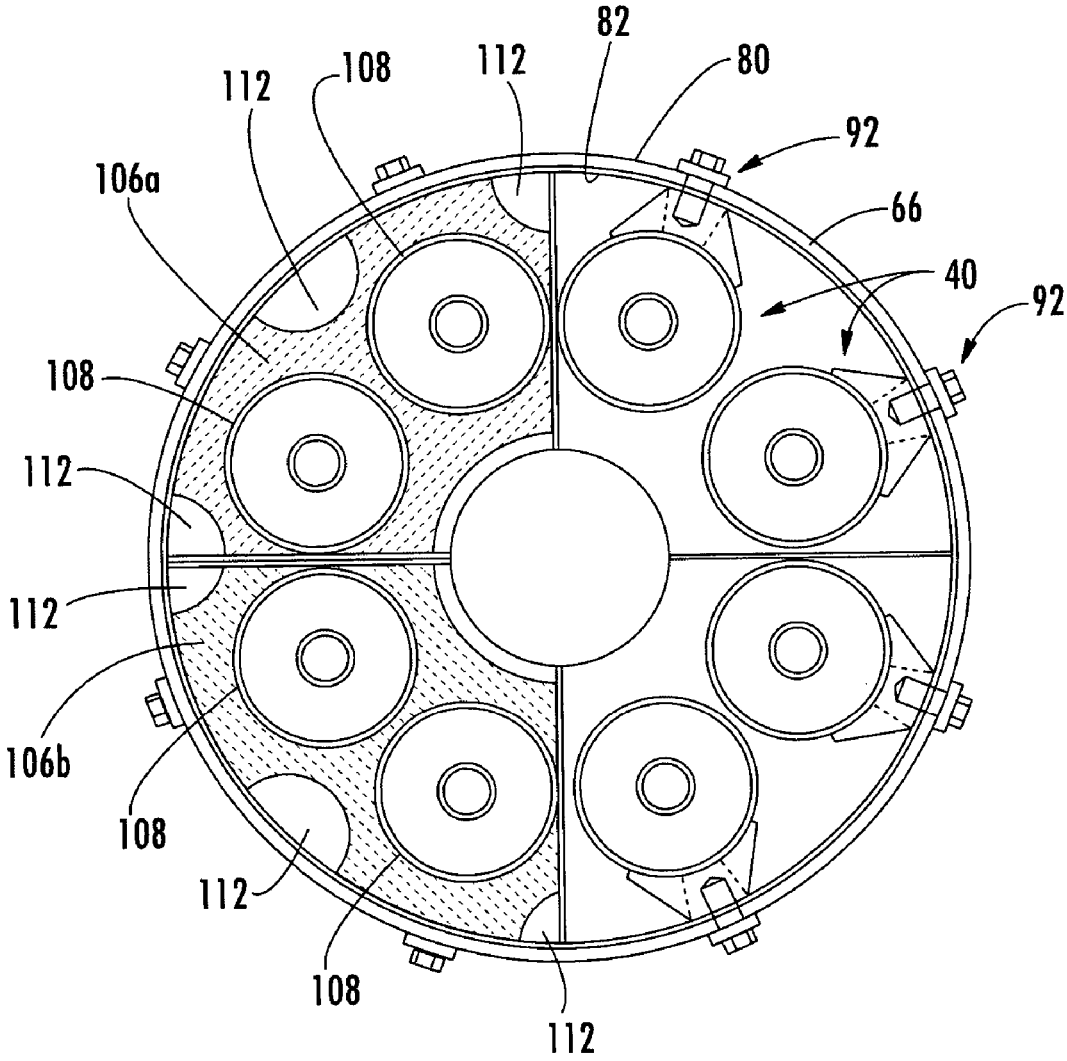
FIG. 7 is a view of bolted swirlers and a support plate system according to aspects of the invention, viewed from line 7-7 in FIG. 6.

Alternatively, a swirler support plate 106 can be provided to support the axial downstream end 62 of the fuel swirler assembly 40, as shown in FIG. 6. The swirler support plate 106 can be secured to the swirler base plate 100 by, for example, welding. In one embodiment, the swirler support plate 106 can have a generally S-shaped profile. The swirler support plate 106 can be a single plate or it can be multiple plates. For instance, the swirler support plate 106 can include four individual panels, only two of such panels 106*a*, 106*b* being shown in FIG. 7. The swirler support plate 106 can provide a plurality of openings 108 for receiving the axial downstream end 62 of each fuel swirler assembly 40, such as the distal axial end 56 of the swirler extension sleeve 52.

The swirler support plate 106 can provide advantages in reducing the potential for flashback, which occurs when the combustion flame travels upstream and attaches to the swirler base plate 100 or the axial downstream end 62 of the fuel swirler assembly 40. Flashback can damage these components and interfere with efficient combustor operation. One way to reduce flashback potential is to provide a film of air on the outside of the fuel swirler assembly 40. Because the axial downstream end 62 of the fuel swirler assembly 40 can be supported by the swirler support plate 106, a gap 110 can be provided between the swirler base plate 100 and the axial downstream end 62 of the fuel swirler assembly 40. Compressed air can be supplied from the compressor to the gap 110 by one or more cutouts 112 provided in the swirler support plate 106. The gap 110 allows a film of air to develop over the axial downstream end 62 of the fuel swirler assembly 40 and the swirler base plate 100, thereby discouraging flashback.

It will be appreciated that, in comparison to the prior welded pin approach, embodiments of the invention described above can reduce the time and cost associated with installing fuel swirlers in the combustor section. The system can avoid the issues associated with the welding process including, for example, distortion and material defects. The attachment system according to aspects of the invention can provide advantages during repair service as the system permits easy replacement of individual swirlers and does not require special tools or fixtures. Further, the design can improve reliability in manufacturing and reduce service cost and time in replacing a swirler. There is also potential for improved swirler alignment because there is no weld distortion introduced at a final assembly.

The foregoing description is provided in the context of one possible system for attaching fuel swirlers to a combustor support frame. It will of course be understood that the invention is not limited to the specific details described herein, which are given by way of example only, and that various modifications and alterations are possible within the scope of the invention as defined in the following claims.

What is claimed is:

1. A fuel swirler assembly for a turbine engine combustor comprising:

an elongated swirler body having an inlet end and an outlet end, the swirler body defining a longitudinal axis, the swirler body having an outer peripheral surface and an inner peripheral surface;

a plurality of swirler vanes extending radially inward from the inner peripheral surface of the swirler body, the vanes being arrayed about the inner peripheral surface of the swirler proximate the inlet end; and a bracket secured to the outer peripheral surface of the swirler body and projecting outward from the swirler body in a direction that is substantially radial to the longitudinal axis, the bracket having a radially distal end, the bracket including a hole adapted for removably receiving a fastener, such that the fastener is attached within the hole the hole extending inward from the radially distal end of the bracket in a direction that is substantially radial to the longitudinal axis, the hole opening to the radially distal end of the bracket, wherein the bracket is located on the swirler body in a region defined between the inlet end and an axially central region of the swirler body.

2. The fuel swirler assembly of claim 1 wherein the bracket and the swirler body are unitary.

3. The fuel swirler assembly of claim 1 wherein the bracket is secured to the swirler body by welding.

4. The fuel swirler assembly of claim 3 wherein the bracket further includes a radially proximal end, and wherein the radially proximal end of the bracket substantially matingly engages the outer peripheral surface of the swirler body.

5. The fuel swirler assembly of claim 1 further including a second bracket secured to the outer peripheral surface of the swirler body, wherein the second bracket is located in a region defined between the inlet end and an axially central region of the swirler body.

6. The fuel swirler assembly of claim 1 further including a second bracket and a swirler extension sleeve, wherein the swirler extension sleeve is secured to the swirler body, wherein the outlet end of the swirler body is received within the swirler extension sleeve, and wherein the second bracket is secured to the swirler extension sleeve.

7. The fuel swirler assembly of claim 1 wherein the hole is threaded, whereby the hole can receive and be in threaded engagement with a threaded fastener.

8. A swirler attachment system comprising:

a combustor support frame having an inner peripheral surface and an outer peripheral surface, a radial hole extending through the combustor support frame from the inner peripheral surface to the outer peripheral surface;

a fuel swirler assembly having an elongated swirler body having an inlet end and an outlet end, the swirler body defining a longitudinal axis, the swirler body having an outer peripheral surface and an inner peripheral surface;

the fuel swirler assembly further including a bracket secured to the outer peripheral surface of the swirler body and projecting outward from the swirler body in a direction that is substantially radial to the longitudinal axis, the bracket having a radially distal end, the bracket including a hole adapted for removably receiving a fastener, the hole extending inward from the radially distal end of the bracket in a direction that is substantially radial to the longitudinal axis, the hole opening to the radially distal end of the bracket, wherein the bracket is located on the swirler body in a region defined between the inlet end and an axially central region of the swirler body; and a fastener extending through the radial hole in the combustor support frame and attached within the hole in the bracket so as to secure the fuel swirler assembly to the combustor support frame, wherein the radially distal end of the bracket substantially engages the inner peripheral surface of the combustor support frame.

9. The system of claim 8 further including a seating surface on the inner peripheral surface of the combustor support frame, wherein the seating surface is adapted for substantially mating engagement with the radially distal end of the bracket.

10. The system of claim 9 wherein the seating surface is defined by a recess in the inner peripheral surface of the combustor support frame, wherein the recess does not extend through the entire thickness of the combustor support frame.

11. The system of claim 8 further including a swirler base plate secured to the combustor support frame, the swirler base plate including an opening, wherein an axial downstream end of the fuel swirler assembly is positioned substantially adjacent to the opening, whereby the fuel swirler assembly and the opening are in fluid communication.

12. The system of claim 8 further including a swirler base plate secured to the combustor support frame, the swirler base plate including an opening, wherein an axial downstream end of the fuel swirler assembly is received within the opening.

13. The system of claim 8 further including:

a swirler support plate, wherein the swirler support plate includes an opening for receiving an axial downstream end of the fuel swirler assembly; and a swirler base plate including an opening, wherein the opening in the swirler support plate is disposed axially upstream of and in substantial alignment with the opening in the swirler base plate, wherein a portion of the fuel swirler assembly is received within the opening in the swirler support plate, wherein the swirler base plate is attached to the combustor support frame and the swirler support plate is attached to the swirler base plate.

14. The system of claim 13 wherein a portion of the fuel swirler assembly extends through the opening in the swirler support plate such that the axial downstream end of the fuel swirler assembly is positioned substantially proximate to the opening in the swirler base plate, wherein a peripheral gap is formed between the axial downstream end of the fuel swirler assembly and the swirler base plate, whereby air can pass through the gap so as to minimize flashback potential.

15. The system of claim 8 wherein the radial hole is adapted to provide a substantially dowel fit with the fastener, whereby movement of the fastener within the hole is substantially minimized.

16. The system of claim 8 further including a lock washer operatively positioned between the fastener and the outer peripheral surface of the combustor support frame, whereby the lock washer impedes unwanted travel of the fastener.

17. The system of claim 8 wherein at least one of the fastener and the hole in the bracket includes a special thread form, whereby unwanted travel of the fastener is impeded.

18. The system of claim 8 wherein the hole in the bracket is threaded and the fastener is a threaded bolt, wherein the hole threadably engages the bolt.

19. The system of claim 9 wherein the seating surface is defined by a protrusion extending radially inward from the inner peripheral surface of the combustor support frame.

20. The system of claim 13 further including a swirler extension sleeve attached to the swirler body, wherein the outlet end of the swirler body is received within the swirler extension sleeve, and wherein the axial downstream end of the fuel swirler assembly is defined by the swirler extension sleeve.

* * * * *